United States Patent [19]

Del Vecchio

[11] 4,084,333

[45] Apr. 18, 1978

[54] FOOTWEAR INNER SOLE

[76] Inventor: Oscar Del Vecchio, Via Manara 6, Falconara Marittima, Ancona, Italy

[21] Appl. No.: 661,045

[22] Filed: Feb. 24, 1976

[30] Foreign Application Priority Data

Jun. 20, 1975 Italy ..... 24630 A/75

[51] Int. Cl.[2] ..... A43B 13/38

[52] U.S. Cl. ..... 36/43

[58] Field of Search ..... 36/43, 11.5

[56] References Cited

U.S. PATENT DOCUMENTS

| | | | |
|---|---|---|---|
| 2,008,207 | 7/1935 | Greenberg | 36/43 X |
| 2,742,717 | 4/1956 | Murray | 36/11.5 X |

FOREIGN PATENT DOCUMENTS

| | | | |
|---|---|---|---|
| 61,951 | 5/1968 | Germany | 36/43 |
| 1,902,255 | 8/1970 | Germany | 36/11.5 |

*Primary Examiner*—Alfred R. Guest

*Attorney, Agent, or Firm*—Haseltine, Lake & Waters

[57] ABSTRACT

An inner sole for footwear comprising a shaped element having a contour which reproduces the profile of the foot and which includes a heel portion, an arch portion and a toe portion. The shaped element has a lateral wall encompassing the contour at the lateral edges thereof, extending from the heel portion to the toe portion to confine and hold the foot of the wearer laterally. The heel portion is provided with a depression into which the heel of the foot of the wearer is received and held. The lateral wall extends substantially vertically from the depression at the rear thereof. The depression extends upwardly and forwardly to merge smoothly with the arch portion. The toe portion includes a transversely arranged raised portion having corrugations to receive the toes of the foot of the wearer.

4 Claims, 3 Drawing Figures

FOOTWEAR INNER SOLE

Figure 1:
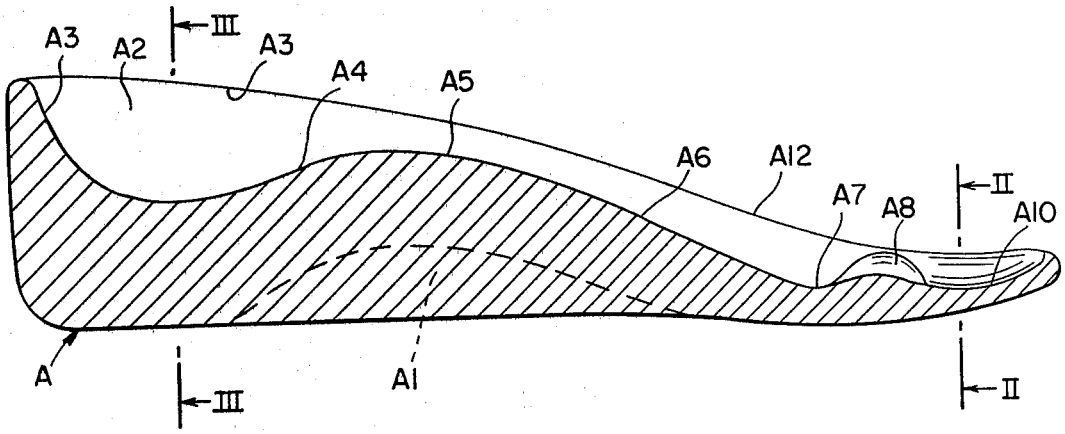

It is a primary object of the invention to provide a footwear inner sole, and particularly an inner sole for the so-called open or slipper type of footwear wherein the rear or back portion of the vamp is restricted to a transverse section which engages the neck of the wearer's foot. The inner sole of the footwear of the invention is so conceived that it permits a normal and proper deambulation thanks to its capability to hold the wearer's foot sole in a complete and rational manner, and this even when the footwear is of substantial height, without transferring to the wearer's limb any abnormal stresses which are likely to fatigue and twist the wearer's foot.

The inner sole of the footwear of the invention is essentially characterized in that it comprises a shaped element whose contour reproduces at least the rear profile of the foot, while its upper part is provided, at the heel, with a depression into which the foot heel portion is received and held, and allows the arch of the sole to rest and adhere against the inner sole of the footwear, whereby the foot is supported from all sides, and yet is free to flex during the deambulation process.

In an advantageous embodiment of the footwear inner sole, which extends to concern the entire foot sole, the upper face of said inner sole of the footwear is provided at the toes with shaped recesses, aligned to form a wavy or corrugated crosspiece which engages the space formed in the connection area between the toes and the body of the foot. Furthermore, the longitudinal edges of the inner sole according to the invention are provided, preferably in the proximity of the rear portion thereof, with raised lugs effective to hold the foot in a transverse direction.

Figure 2:
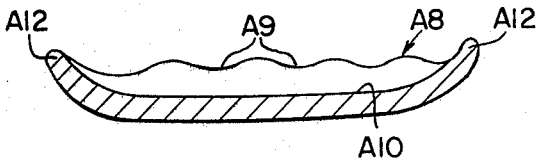
Figure 3:
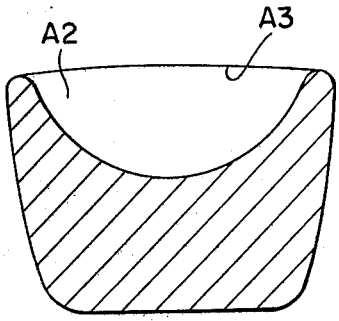

The invention will become more apparent from the description that follows, to be read in conjunction with the accompanying drawing which illustrates, by way of example, a preferred embodiment of the inner sole of the instant footwear. In the drawing:

FIG. 1 is a longitudinal sectional view of the inner sole of the footwear; and FIGS. 2 and 3 are sectional views taken along the lines II—II and III—III of FIG. 1.

The illustrated inner sole is made of a suitable material such as cork, or advantageously formed from a molded plastic material, the latter making it possible to manufacture easily and economically an inner sole which exactly reproduces the profile as desired and meets its funtional requirements.

The body A of the inner sole of the footwear presents a contour which reproduces the shape of the foot, and has its upper part conveniently shaped, as explained hereinafter, whereas the lower part of said inner sole may be flat or be formed with recesses A1, as shown in dotted lines in FIG. 1.

The upper part of the inner sole A, toward the rear portion thereof, is provided with a large depression A2 having a substantially parabolic contour. The bottom of said depression is arcuate such as to form at the rear a practically vertical wall A3, while said bottom is connected forwardly to a section A4 which slopes upwardly in a generally horizontal direction to form, substantially together with the middle portion of the inner sole, an arched section with its top at A5, said arched section, still by a limited downward inclination, extending with a section A6 toward the front or forward end of the inner sole.

As seen in FIG. 3 the height of the inner sole at the heel portion is comparable to the width thereof and the depression A2 extends about one-half the height of the sole. A substantial heel thickness with a retaining pocket formed by the depression A2 is obtained. The thickness of the sole at the depression is much greater than at the toe region as seen in FIG. 1.

The intermediate section A6 terminates toward the tip of the inner sole A, with a recess A7 defined forwardly by a rib or crosspiece A8 extending from side to side across the inner sole.

The crosspiece A8 is provided at the top with arcuate recesses A9 which form resting supports for the base of the wearer's toes.

The inner sole A is further formed, forward of the corrugated crosspiece A8, with another depression or recess A10 into which the toes are freely received. The longitudinal edges of the inner sole, particularly toward the front and rear ends thereof, are provided with lugs or wings A12 pointing upwards and forming containment and transverse confinment surfaces for the wearer's foot. The height of the wings A12 is greater than the height of the corrugated crosspiece A8 as seen in FIG. 2.

Considering the advantageous possibility of making the inner sole of the instant footwear of molded plastic materials, the inner sole A may be made of a plastic material providing various physical properties such as resiliency and flexibility. In this case, the plastic materials with a higher degree of flexibility will be concentrated at the proper areas, e.g. at A7, whereas the walls A3 will be made of more rigid plastic materials, such that said areas are conferred a degree of flexibility proportionate to their specific functions.

It will thus appear that with the inner sole according to the invention it becomes possible to provide open top footwear articles which are satisfactory from all point of views, and allow a quick and satisfactory deambulation process. This results from the fact that the instant inner sole permits the foot heel portion to seat itself lower down, whereby the foot is at all times supported in a complete and uniform manner, thus ensuring that the wearer's own weight is constantly and uniformly distributed over the entire sole area.

It is obvious, then, that the inner sole of the invention permits open or slipper type of footwear to be manufactured which, thanks to the flexibility of the lugs A12, remain constantly secured to the wearer's feet, following their motion and permitting rapid walking without difficulties or uncertainty.

Of course, this application is also intended to cover the footwear article which incorporates the instant inner sole design.

The materials used in practicing the invention may vary to suit different applicational requirements, and particularly as regards the location of the areas with different degrees of flexibility, whereby all such variations and modifications which fall within the scope of this application are hereby included and claimed.

What is claimed is:

1. A footwear inner sole, particularly for open top footwear articles, comprising a resilient shaped element having a contour which reproduces the profile of the foot, said shaped element including a heel portion, an arch portion and a toe portion, said shaped element further including a lateral upturned wall encompassing said contour at the lateral edges thereof from said heel portion to said toe portion to confine and hold the foot to the wearer laterally, said heel portion being provided with a depression into which the heel of the foot of the wearer is received and held, said lateral wall extending substantially vertically from said depression at the rear thereof, said heel portion extending upwardly and forwardly at the front of said deepression to merge smoothly with said arch portion, said toe portion including a transversely arranged raised portion having corrugations to receive the toes of the foot of the wearer, the height of the shaped element at the heel portion being comparable to the width thereof, the depression at the heel portion being about one-half the height thereat, said heel portion having a thickness substantially greater than the thickness at the toe portion and positioning the heel of the wearer at a higher level than the toes.

2. A footwear inner sole according to claim 1 wherein said shaped element is made at least in part of a molded plastic material having regions with different resilience, whereby the flexing of said shaped element may be adjusted locally.

3. A footwear inner sole according to claim 1 wherein said lateral wall extends to a height at the rear of said depression which is above the level of said arch.

4. A footwear inner sole according to claim 1 wherein the lateral walls at said toe section extend above the level of said transversal, arranged portion with the corrugations.

* * * * *